US012668937B2

(12) United States Patent
Kirchmair et al.

(10) Patent No.: US 12,668,937 B2
(45) Date of Patent: Jun. 30, 2026

(54) SNOWGROOMER AND METHOD FOR CONTROLLING A SNOWGROOMER

(71) Applicant: PRINOTH S.P.A., Vipiteno (IT)

(72) Inventors: Martin Kirchmair, Vipiteno (IT); Francesco Salis, Vipiteno (IT); Alberto Paoletti, Vipiteno (IT)

(73) Assignee: PRINOTH S.P.A., Vipiteno (IT)

( * ) Notice: Subject to any disclaimer, the term of this patent is extended or adjusted under 35 U.S.C. 154(b) by 474 days.

(21) Appl. No.: 18/267,370

(22) PCT Filed: Dec. 16, 2021

(86) PCT No.: PCT/IB2021/061858

§ 371 (c)(1),
(2) Date: Jun. 14, 2023

(87) PCT Pub. No.: WO2022/130279

PCT Pub. Date: Jun. 23, 2022

(65) Prior Publication Data

US 2024/0060258 A1 Feb. 22, 2024

(30) Foreign Application Priority Data

Dec. 16, 2020 (IT) ..... 102020000031076

(51) Int. Cl.
*E01H 4/02* (2006.01)
*E01H 5/06* (2006.01)

(52) U.S. Cl.
CPC ..... *E01H 4/02* (2013.01); *E01H 5/061* (2013.01)

(58) Field of Classification Search
CPC ..... E01H 4/00; E01H 4/02; E01H 5/061; H04W 4/40; H04W 4/44; B62D 55/00;
(Continued)

(56) References Cited

U.S. PATENT DOCUMENTS

2002/0156574 A1* 10/2002 Fortin ..... B62D 55/30 701/469
2022/0035320 A1* 2/2022 Tschinkel ..... E01H 4/00

FOREIGN PATENT DOCUMENTS

EP 0 160 195 A2 11/1985
EP 1 182 409 A1 2/2002
WO WO 2020/065607 A1 4/2020

OTHER PUBLICATIONS

Notification Concerning Submission, Obtention or Transmittal of Priority Document for International Application No. PCT/IB2021/061858 dated Dec. 27, 2021.

(Continued)

*Primary Examiner* — Alicia Torres
*Assistant Examiner* — Robert E Pezzuto
(74) *Attorney, Agent, or Firm* — Neal, Gerber & Eisenberg LLP

(57) ABSTRACT

A snow groomer vehicle including a frame, two tracks, and a drive unit connected to the two tracks to move the snow groomer vehicle. The snow groomer vehicles includes at least one working device selected from the group of working devices including: a winch, a tiller assembly, and a shovel, in particular the working device being connected to the frame by a connecting device. The snow groomer vehicle includes at least one control device configured to control at least one parameter of the snow groomer vehicle, preferably relating to the tracks or to the at least one working device, the control device being configured to control in a first operating mode the at least one parameter based on the operator's control instructions received via the user interface, on the data received via the radio communication unit, and on the position detected via the position detector.

25 Claims, 4 Drawing Sheets

(58) Field of Classification Search
CPC ..... B62D 55/06; B62D 55/065; B60K 35/10; B60K 35/22; B60K 35/28; B60K 35/81; G07C 5/00; G07C 5/008; G01N 33/18; G01N 33/1873
See application file for complete search history.

(56) References Cited

OTHER PUBLICATIONS

International Search Report and Written Opinion for International Application No. PCT/IB2021/061858 dated Apr. 5, 2022.

* cited by examiner

SNOWGROOMER AND METHOD FOR CONTROLLING A SNOWGROOMER

PRIORITY CLAIM

This application is a national stage application of PCT/IB2021/061858, filed on Dec. 16, 2021, which claims the benefit of and priority to Italian Patent Application No. 102020000031076, filed on Dec. 16, 2020, the entire contents of which are each incorporated by reference herein.

TECHNICAL FIELD

This disclosure concerns a snow groomer vehicle and a method for controlling a snow groomer vehicle. In addition, this disclosure concerns a management system for a snow groomer vehicle, a ski resort comprising this management system, and a method for managing a ski resort.

BACKGROUND

A snow groomer vehicle is used by professional operators who are instructed in the use of a snow groomer vehicle. Usually, the snow groomer vehicles are used at night because the ski slopes are free and not occupied by users. In addition, the snow groomer vehicles operate on snowy slopes where obstacles and sources of danger cannot be immediately recognised due to the presence of snow throughout the surrounding environment. In addition, a snow groomer vehicle may be used by expert operators and less expert ones who do not know the environment in which they are operating, and the associated risks, perfectly.

For this reason, the use of a snow groomer vehicle may entail risks for the operator, for people around the snow groomer vehicle, and for the surrounding environment due to various factors, for example due to there being excessive snow on the slope that makes it more difficult to recognise surrounding obstacles and sources of danger either due to scarce visibility owing to particular weather conditions, or due to the operator's scarce knowledge of a particular place where they are operating, for example, a particular slope on which they are operating, or due to the inexperience of an operator, perhaps an operator who does not have a great deal of experience in the use of snow groomer vehicles in general or of the particular snow groomer vehicle that they are operating.

SUMMARY

The purpose of this disclosure is to provide a snow groomer vehicle that reduces certain of the drawbacks of certain of the prior art.

According to this disclosure, therefore, a snow groom vehicle comprising the following is provided: a frame; two tracks; a drive unit connected to the two tracks to move the snow groomer vehicle; at least one working device selected from a group of working devices including: a winch, a tiller assembly, and a shovel, in particular the working device being connected to the frame by a connecting device; at least one control device configured to control at least one parameter of the snow groomer vehicle, such as related to the tracks or the at least one working device, in particular the at least one parameter being selected from a group comprising the following parameters: speed of the snow groomer vehicle; number of revolutions of the drive unit; switching on of a light assembly of the snow groomer vehicle; settings of the tiller; settings of the winch; settings of the blade; positions of the blade with respect to the three Cartesian axes; settings of the snow groomer vehicle; setting of the suspension of the snow groomer vehicle; a message to be sent to a display screen of the snow groomer vehicle; setting of the speed limit; setting of alarms; warnings concerning driving direction, in particular warnings concerning critical area entry; warning of risk of collision with static or dynamic objects; distance indicator to other snow groomer vehicles such as during operations of fleet snow groomer vehicles; direction of rotation of a shaft of the tiller assembly; depth and/or angle of cut of the tiller assembly, such as of the tiller; position of the tiller assembly along a vertical axis; mode of adjusting the position of the tiller assembly along a vertical axis, in certain instances, from among; a mode in which the tiller assembly is in a fixed position, a mode in which the tiller assembly exerts a given pressure on the snowpack in addition to its own weight or subtracted from its own weight and said exerted pressure value, and a mode in which the tiller assembly is in a floating position, in particular, in the floating position, it follows the snowpack; position of the wings, open or closed; volume of a working chamber of the tiller; position of the tiller with respect to a horizontal plane; mode of adjusting the position of the tiller with respect to a horizontal plane preferably between a mode in which the tiller assembly is in a fixed position, and a mode in which the tiller assembly is in a floating position, in particular, in the floating position, it follows the movements of the snow groomer vehicle; and position of the finisher; the snow groomer vehicle comprising a radio communication unit coupled to the control device and configured to receive data from the outside and preferably send data to the outside, and configured to provide the data received from the outside to the control device; the snow groomer vehicle comprising a user interface comprising at least one control for receiving control instructions from an operator relating to the at least one parameter of the snow groomer vehicle and coupled to the control device so as to send thereto the control instructions received from the operator; the snow groomer vehicle comprising a position detector, in particular of the GNSS type, configured to detect the position preferably within a ski resort and coupled to the control device so as to send the detected position to the control device; the control device being configured to control in a first operating mode the at least one parameter based on the operator's control instructions received via the user interface, on the data received via the radio communication unit, and on the position detected via the position detector.

In accordance with the present disclosure, the use of the snow groomer vehicle is relatively safer for an operator because it is possible to set parameters for the snow groomer vehicle, for example remotely, so as, for example, to limit the speed in some areas that are particularly relatively dangerous, or to switch on the lights or to implement various functions to improve the relative safety of the snow groomer vehicle when the snow groomer enters some areas that are defined beforehand as relatively dangerous.

Another purpose of this disclosure is to provide a method of controlling a snow groomer vehicle that reduces certain of the drawbacks of certain of the prior art.

BRIEF DESCRIPTION OF THE DRAWINGS

Additional characteristics and advantages of this disclosure will be clear from the description that follows of non-limiting embodiments, with reference to the attached figures, in which.

DETAILED DESCRIPTION

Figure 1:
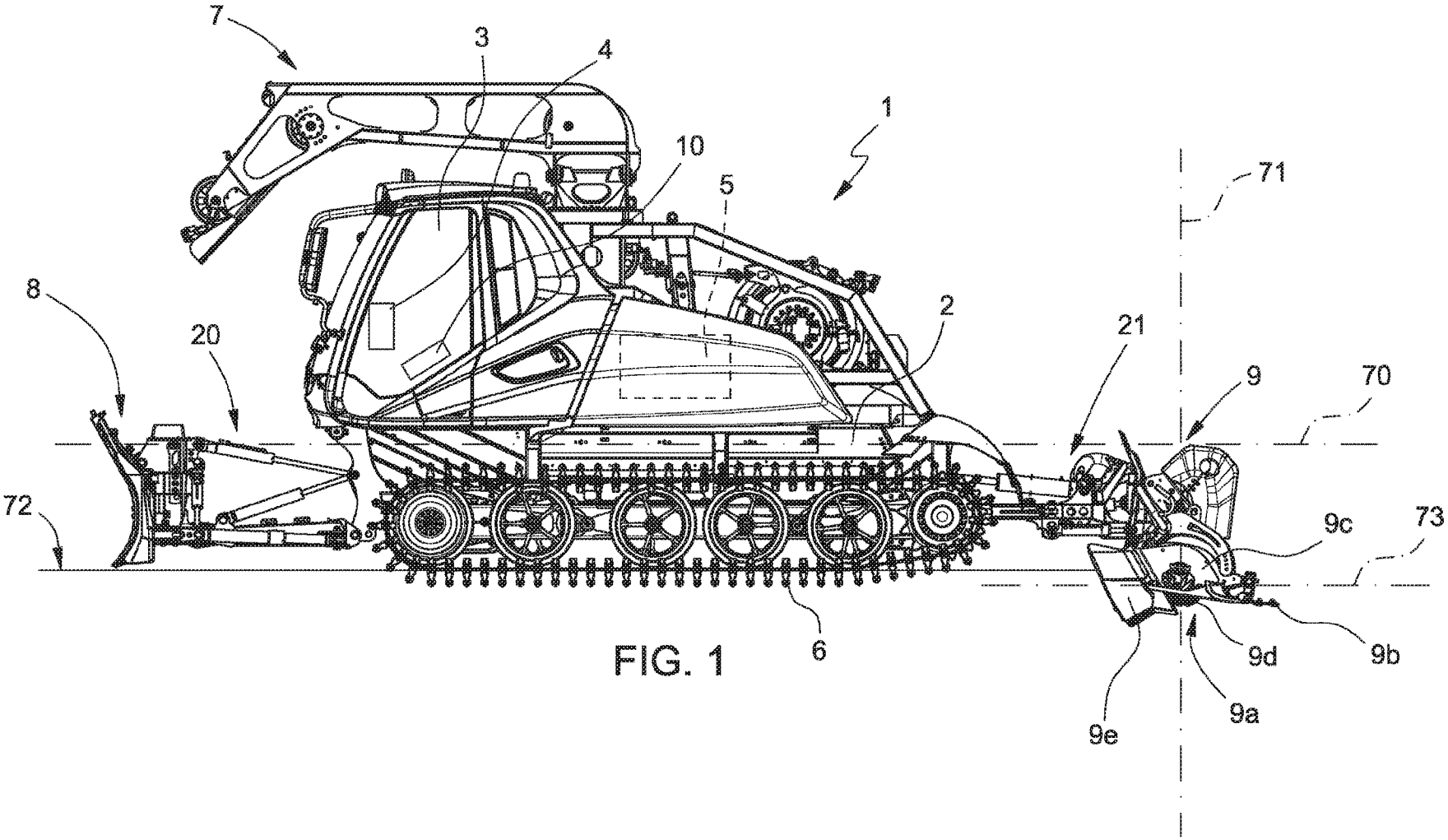
FIG. 1 is a side view of a snow groomer vehicle in accordance with an embodiment of this disclosure.
Figure 2:
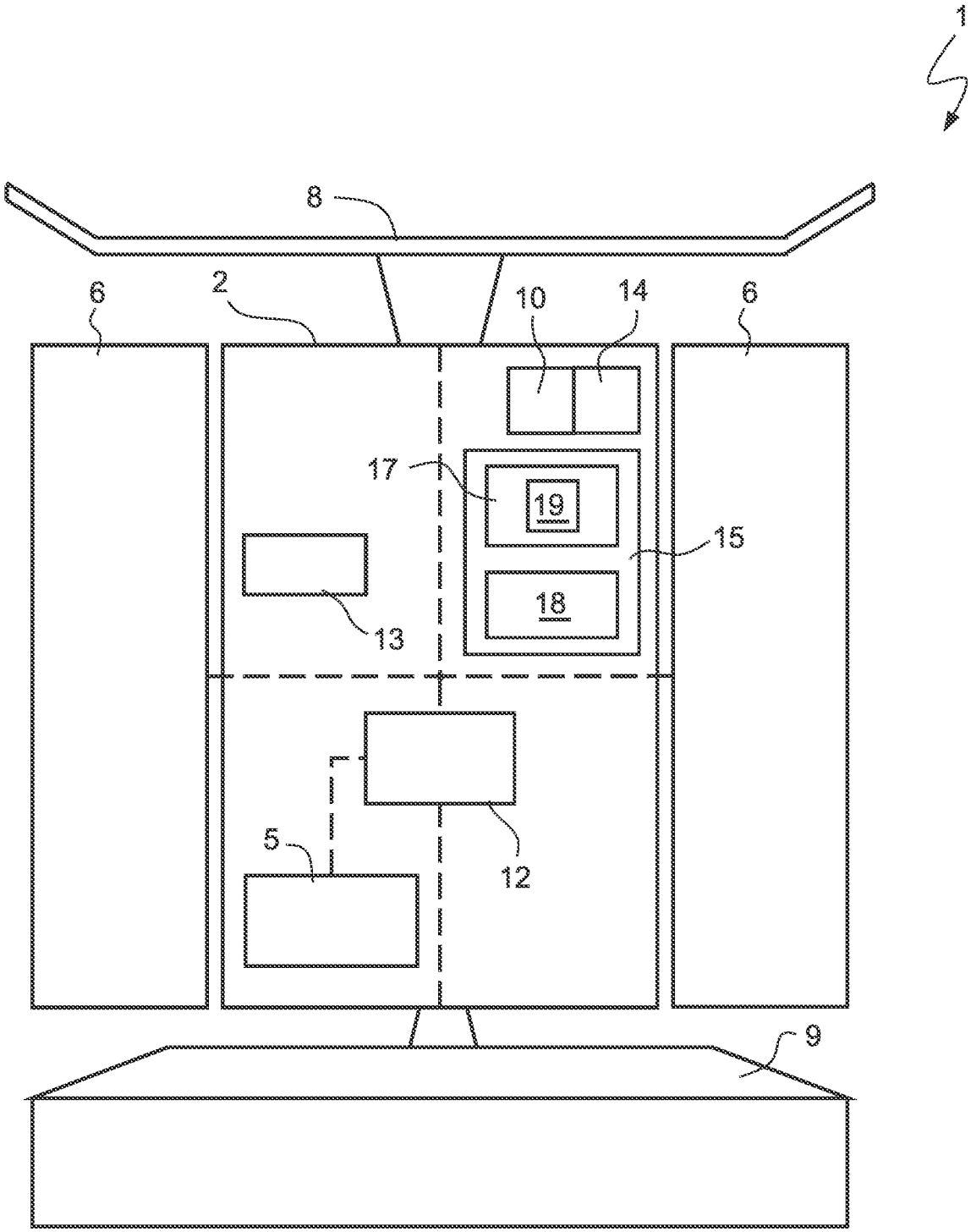
FIG. 2 is a simplified block diagram of the snow groomer vehicle in FIG. 1.

With reference to FIGS. 1 to 2, the reference number 1 denotes a snow groomer vehicle, according to one embodiment of this disclosure, as a whole, and comprises a frame 2, which extends along a longitudinal axis 70, a driving cabin 3, and a drive unit 5, for example an internal combustion engine. The driving cabin 3 and the drive unit 5 are housed on the frame 2. The snow groomer vehicle 1 is, in addition, provided with a pair of tracks 6 and with at least one user device. The at least one user device is defined by one or more of the following devices; a shovel or blade 8, supported at the front by the frame 2; a winch 7; and a tiller assembly 9 comprising a tiller 9*a* and such as a finisher 9*b*, supported at the back by the frame 2. In more detail, the disclosure refers to a snow groomer vehicle 1 that has, as a user device, for example, only the tiller assembly 9 or only the shovel 8 or only the tiller assembly 9 and the shovel 8 or other possible combinations of user devices.

The drive unit 5 provides the necessary power to operate the snow groomer vehicle 1 and, in particular, to the tracks 6 and at least to the user device 7, 8, and/or 9.

The transmission of power 12 may be hydraulic or electric or a combination of hydraulic and electric.

The drive unit 5 may be an electric motor with a rechargeable battery or an internal combustion engine. Alternatively, the drive unit 5 may be a hybrid motor comprising an internal combustion engine and an electric motor connected in series or in parallel. In another embodiment, the drive unit 5 may be a fuel cell engine fed with hydrogen.

The tiller 9*a* in particular comprises a rotating shaft 9*d* provided with teeth and a protection casing 9*c* that is arranged above the rotating shaft 9*d*. The area between the protection casing 9*c* and the rotating shaft 9*d* is called the working chamber and is configured to have a variable volume. In particular, the tiller 9*a* comprises a device configured to vary the distance between the rotating shaft 9*d* and the protection casing 9*c* or to vary the position of the finisher 9*b*. Thus, the volume of the working chamber may be adjusted. This device may act on the rotating shaft 9*d*, adjusting its position or it may act on the protection casing 9*c*, by adjusting its position, or it may act on the finisher 9*b*, by varying its position. By varying the working chamber, you obtain a different tilling of the processed snowpack.

The tiller assembly 9 comprises two side wings 9*e* arranged laterally to the protection casing 9*c*.

In one embodiment not illustrated in the attached figures, the tiller assembly 9 comprises two tillers 9*a* that are connected to each other via a (in certain instances, universal) joint. In this embodiment, each of the two tillers 9*a* comprises a rotating shaft 9*d* provided with teeth and a protection casing 9*c* that is arranged above the rotating shaft 9*d*.

The snow groomer vehicle 1 comprises a user interface that is installed in the driving cabin 3 and enables an operator to control one or more parameters of the snow groomer vehicle including, in certain instances: the speed of the snow groomer vehicle 1, the operation of the user devices, the operation of the lights, and the parameters of the drive unit 5.

In particular, the user interface comprises drive controls 10 for the snow groomer vehicle 1 to control one or more snow groomer vehicle 1 parameters. In more detail, through the drive controls 10, an operator sends control instructions to the snow groomer vehicle 1 to control one or more parameters of the snow groomer vehicle 1.

The drive controls 10 may comprise one or more of the following elements: a steering wheel, levers, one or more pedals, multiple buttons, a touch screen, a joystick comprising a lever, preferably said joystick comprises at least one slider and at least one mini-lever, especially housed on said lever.

Throughout the text, the phrase "one or more parameters of the snow groomer vehicle" means one or more of the following parameters: snow groomer vehicle speed 1; number of revolutions of the drive unit 5; switching on a light assembly of the snow groomer vehicle 1; settings of the tiller assembly 9; settings of the winch 7; settings of the blade 8; positions of the blade 8 with respect to the three Cartesian axes; settings of the snow groomer vehicle 1; setting of the suspension of the snow groomer vehicle 1; a message to be sent to a display screen of the snow groomer vehicle 1; speed limit setting; setting of alarms; warnings concerning driving direction, in particular warnings concerning critical area entry; warning of risk of collision with static or dynamic objects; distance indicator to other snow groomer vehicles 1 such as during operations of fleet snow groomer vehicles; direction of rotation of the shaft 9*d*; depth and/or angle of cut of the tiller assembly 9, preferably of the tiller 9*a*; position of the tiller assembly 9*a* along a vertical axis 71; mode of adjusting the position of the tiller assembly 9 along a vertical axis 71, preferably from among: a mode in which the tiller assembly 9 is in a fixed position, a mode in which the tiller assembly 9 exerts a given pressure on the snowpack 72 in addition to its own weight or subtracted from its own weight and said exerted pressure value, and a mode in which the tiller assembly 9 is in a floating position, in particular, when in the floating position, the position of the tiller assembly 9 follows the snowpack 72; position of the wings 9*e*, whether open or closed; volume of a working chamber of the tiller 9*a*; position of the tiller 9*a* with respect to a horizontal plane 73; mode of adjusting the position of the tiller 9*a* with respect to a horizontal plane 73 preferably between a mode in which the tiller assembly 9 is in a fixed position, and a mode in which the tiller assembly is in a floating position, in particular, when in the floating position, the tiller assembly follows the movements of the snow groomer vehicle 1; and position of the finisher 9*b*.

In addition, in the embodiment described above wherein the tiller assembly 9 comprises two tillers 9*a* connected to each other via a joint (such as a universal joint), the phrase "parameters of the snow groomer vehicle" may also comprise one of more of the following parameters: mode for adjusting the relative position between the two tillers 9*a* of the tiller assembly 9, in particular between one mode in which the relative position between the two tillers 9*a* is free and, as a result, the two tillers 9*a* are free to move independently of each other, one mode in which the position of the two tillers 9*a* is fixed so that the two tillers 9*a* form a given angle between them equal to 180° and lying on a plane that is oblique to the snowpack 72 (in particular, the angle faces the snowpack 72), a mode in which the position of the two tillers 9*a* is fixed so that the two tillers 9*a* form a given angle of less than 180° between them and lying on a plane oblique to the snowpack 72 (in particular, the angle faces the snowpack), and a mode in which the position of the two tillers 9*a* is fixed so that the two tillers 9*a* form a given angle greater than 180° between them and lying on a plane oblique to the snowpack 72 (in particular, the angle faces the snowpack 72). As a result, in this embodiment, the drive control 10 may also control one or more parameters of the snow groomer vehicle cited in this paragraph.

In more detail, the warnings concerning driving direction, in particular warnings concerning critical area entry, may be related, for example, to warnings regarding entry into a black slope, especially via a flashing indicator on the user interface indicating the direction of warning.

In more detail, the indicator of distance from other snow groomer vehicles, preferably during operations of fleet snow groomer vehicles, in particular indicates whether the distance between the other snow groomer vehicles of the fleet is continuously maintained.

In addition, the warning of risk of collision with static or dynamic objects, in particular, is a warning that indicates whether one is about to collide with static objects that were previously located on the map M or with dynamic objects, in particular moving ones, which send their position to a processing unit as will be seen below.

In certain embodiments, one of the parameters of the snow groomer vehicle controlled via the drive controls 10 is the speed of the snow groomer vehicle 1, in particular the movement of the tracks 6 in order to define the movement speed of the snow groomer vehicle 1.

In certain embodiments, one of the parameters of the snow groomer vehicle controlled via the drive controls 10 is the direction of the snow groomer vehicle 1, in particular the movement of the tracks 6 in order to define the movement direction of the snow groomer vehicle 1.

In another embodiment, some of the snow groomer vehicle 1 parameters controlled via the drive controls 10 relate to the user devices.

In another embodiment, some of the snow groomer vehicle 1 parameters controlled via the drive controls 10 are the lights of the snow groomer vehicle.

With reference to FIG. 1, the blade 8 is connected to the frame 2, via a front connecting device 20, while the tiller assembly 9 is connected to the frame 2 via a back connecting device 21.

The drive control 10 is configured to control the front connecting device 20 and makes it possible to control shovel parameters, in particular shovel 8 positions.

In addition, the drive control 10 is configured to control the back connecting device 21.

With reference to the figures, the back connecting device 21 also comprises an actuator assembly 50 (FIG. 2) to control parameters relating to the tiller assembly 9.

The snow groomer vehicle 1 comprises a control system 15 that detects the parameters (listed above) of the snow groomer vehicle 1.

In certain embodiments, the control system 15 detects one or more parameters of the snow groomer vehicle 1: the power delivered by the drive unit 5; the snow groomer vehicle 1 speed; the number of engine revolutions of the drive unit 5; the state of the lights of the snow groomer vehicle 1; the settings of the suspension of the snow groomer vehicle 1; the power absorbed by each of the user devices, in particular of the winch 7 and/or of the blade 8 and/or of the tiller 9; a position of the blade 8 and a position of the tiller assembly 9.

The control system 15 comprises a control device 17.

In one non-limiting embodiment, the user interface comprises a display screen 4 that is configured to show information regarding one or more of the parameters of the snow groomer vehicle 1 described above.

In certain embodiments, the display screen 4 is a touch screen; as a result, the operator may use the screen as drive control 10 for one or more of the parameters of the snow groomer vehicle 1.

The snow groomer vehicle 1 comprises a position detector 13, for example a satellite navigation device of the GNSS ("Global Navigation Satellite System") type, for example of the GPS or Galileo or Glonass type (or a combination of these), configured to detect the position preferably within a ski resort 200 (FIG. 4) and coupled to the control system 15, in particular to the control device 17, to send thereto the position detected within the ski resort 200.

In more detail, the position detector 13 is configured to determine, preferably with precision in the order of centimetres, its three-dimensional position and orientation and, as a result, the three-dimensional position and orientation of the snow groomer vehicle 1. In practice, the position detector 13 makes it possible to determine longitude LG, latitude LT, and, preferably, height above ground H, in addition to forward direction.

The control system 15 is equipped with wireless connection capacity, for example directly through a local communication network or through a mobile data network, and an internet connection, for connecting to a management system of a ski resort.

In particular, the control system 15 comprises a radio-wave communication unit 18 coupled to the control device 17, configured to receive data remotely and provide them to the control device 17 and, preferably, to send data from the control device 17 outside. In one such embodiment, the remote data sent to the snow groomer vehicle 1 via the communication unit 18 comprise data relating to a map M, to an area 50 of the map M, to at least one of the parameters of the snow groomer vehicle 1, associated with said area 50, and to a value or to a range of values of said parameter.

The user interface is coupled to the control system 15, in particular to the control device 17, to send thereto the operator's control instructions received via the user interface controls 10.

The control device 17 is configured to control at least one of the parameters illustrated above of the snow groomer vehicle 9. In other words, the control device 17 is configured to control the behaviour of the snow groomer vehicle 1.

In particular, the control device 17, as mentioned above, receives the control instructions of the operator received via the user interface controls 10, remote data via the radio communication unit 18, and the position via the position detector 13.

The control device 17 is configured to control in a first operating mode the at least one of the parameters of the snow groomer vehicle 1 (described above) based on the control instructions received via the user interface controls 10, on the data received via the radio communication unit 18, and on the position detected via the position detector 13.

In certain embodiments, the control device 17 comprises a memory 19 configured to store the data received from the radio communication unit 18, in particular the data comprise a map M and/or the data relating to a map M, to an area 50 of the map M, to at least one of the parameters of the snow groomer vehicle 1, associated with said area 50, and to a value or to a range of values of said parameter. In other words, the control system 15 receives, from the outside (via the communication unit 18), a map M and/or data relating to a map M, preferably of the ski resort on which they are operating, an area of the map M and/or data relating to an area 50 of the map M, preferably at least one of the parameters of the snow groomer vehicle 1 associated with said area 50, and, in particular, a value or a range of values of said parameter, and stores them in the memory 19.

In use, the control device 17 is configured to control, in the first operating mode, at least one of the parameters of the snow groomer vehicle 1 described above based on the control instructions received via the user interface controls 10; on the data stored in the memory 19 and relating to the map M, to the area of the map M, and to the parameter associated with the area of the map M and a value or a range of values associated with said parameter; and on the position detected via the position detector 13.

In more detail, the control device 17 is configured to determine whether the snow groomer vehicle 1 is within at least one area 50 of the map M based on the position received by the position detector 13 and to control the at least one of the parameters indicated by the data in the memory 19 based on the presence, or lack thereof, of the snow groomer vehicle 1 in the at least one area 50 of the map M and, preferably, based on the controls 10 of the operator received via the user interface.

In more detail, the control device 17, if it detects that the position of the snow groomer vehicle 1 is within the area 50 of the map M, controls the at least one of the parameters of the data in the memory 19 based on the control instructions received via the user interface controls 10, according to the first operating mode and based on the values of range of values relating to said parameter and stored in the memory 19. For example, in the first operating mode it is possible to limit the maximum value of the at least one of the parameters or to set ranges of values within which the at least one of the parameters must be or to set one specific value of at least one of the parameters by setting these data remotely and sending these data to the snow groomer vehicle 1 via the communication unit 18, in this way these data will be stored in the memory 19 and the control device 17 will control the parameters indicated by the data sent remotely according to the values or the range of values indicated by the data sent remotely if the snow groomer vehicle 1 is located in the area 50 of the map M indicated by the data sent remotely.

In addition, the control device 17, if it detects that the position of the snow groomer vehicle 1 is outside the area 50 of the map M, it controls the at least one of the parameters indicated by the data, preferably directly, based on the operator's control instructions received via the user interface controls 10, according to a second operating mode. In the second operating mode, the at least one of the parameters preferably indicated by the data sent via the radio communication unit 18, corresponds to the values set by the operator using the user interface controls 10 without, for example, limitations regarding maximum value or a range or pre-set values, as in the first operating mode.

In certain embodiments, the user interface comprises at least one operating command 14 that can be driven by the operator and in which the control device 17 is configured to control, in the second operating mode, the at least one of the parameters based on the control instructions received via the user interface controls 10, when it receives the operating command from the operator. In particular, in this case, being in the second operating mode, the control device controls the at least one of the parameters, in particular without taking into account the values or range of values of the at least one of the parameters of the data received via the communication unit 19, and of the position detected via the position detector 13. In other words, the control device 17 is configured to control the at least one of the parameters in the second operating mode (i.e., directly based on the operator's command), when the at least one operating command 14 is activated by the operator.

The operating command 14 may be defined by a button in the user interface or may be defined by a specific value of the control 10, for example when the control 10 is a pedal, the operating command 14 may be defined by the control 10 being fully activated (i.e., by the pedal being fully pressed), or if the control 10 is a lever, the operating command 14 may be defined by the control 10 being fully activated, for example the lever is fully pressed.

In another embodiment, the command 14 may be defined by a specific range of values of the control 10. For example, when the control 10 is a pedal, the operating command 14 may be defined by the control 10 being activated within a specific range, for example, activated by a value greater or equal to 70% or 80% or 90% or 95% or 99% or 100%, or if the control 10 is a lever, the operating command 14 may be defined by the control 10 being activated within a specific range, for example activated by a value greater or equal to 70% or 80% or 90% or 95% or 99% or 100%.

In certain embodiments of this disclosure, the at least one of the parameters is the speed of the snow groomer vehicle 1 and/or the number of engine revolutions of the snow groomer vehicle 1; as a result, the control device 17 is configured to adjust the speed of the snow groomer vehicle 1 and/or the number of engine revolutions of the snow groomer vehicle 1 based on the position detected via the position detector 13, in particular limiting it to a maximum value. The control device 17 is preferably configured to adjust, in particular limiting to a maximum value, the speed of the snow groomer vehicle 1 and/or the number of engine revolutions of the snow groomer vehicle 1 if the snow groomer vehicle 1 is within the at least one area 50 of the map M. In this embodiment, the control 10 is preferably defined by a pedal or by a lever and the command 14 is defined by the value of the pedal or of the lever activated by a value greater or equal to 70% or 80% or 90% or 95% or 99% or 100%.

In certain embodiments of this disclosure, the at least one of the parameters is switching on a light assembly of the snow groomer vehicle 1; as a result, the control device 17 is configured to switch on a light assembly of the snow groomer vehicle 1 based on the position detected by the position detector 17. In particular, it is configured to switch on a light assembly of the snow groomer vehicle 1 if the snow groomer vehicle 1 is within the at least one area 50 of the map M.

In certain embodiments of this disclosure, the parameter is a message to be sent to the display screen 4 of the snow groomer vehicle 1. In particular, in this embodiment, the control device 17 is configured to send a message to the display screen 4 based on the position detected by the position detector 13, in particular it is configured to send a message to the display screen 4 if the snow groomer vehicle is within the at least one area 50 of the map M.

Figure 3:
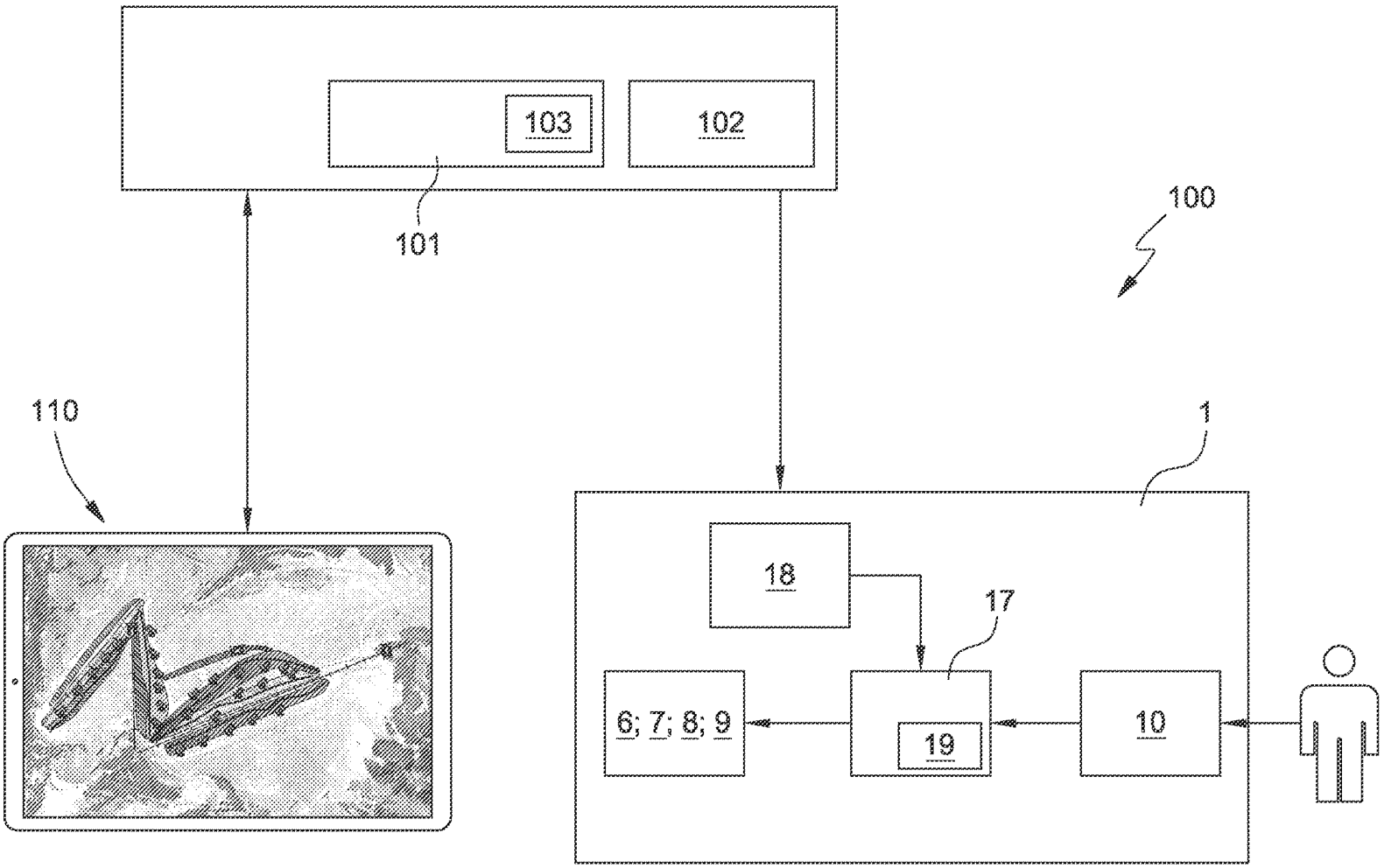
FIG. 3 is a block diagram of a management system of the snow groomer vehicle in FIG. 1.

In an embodiment of this disclosure illustrated in FIG. 3, the snow groomer vehicle just described is part of a management system 100 of a snow groomer vehicle. The management system 100 of the snow groomer vehicle comprises one or more snow groomer vehicles 1 of the type illustrated above, a processing unit 101, and a communication unit 102 coupled in communication with the snow groomer vehicle 1, in particular with the radio communication unit 18 of the snow groomer vehicle 1.

In addition, the processing unit 101 comprises a memory 103 on which the following are stored: the map M and/or the data relating to it, the at least one area 50 of the map M and/or the data relating to it, the at least one of the parameters associated with the at least one area 50 of the map M, and the at least one value or range of values associated with the at least one of the parameters.

The processing unit 101 is configured to send one area 50 of the map M and/or the data relating to it, the at least one of the parameters associated with the at least one area 50 of the map M, and the at least one value or range of values associated with the at least one of the parameters to the snow groomer vehicle via the communication unit 102 and the radio communication unit 18. In one embodiment, the processing unit 101 is configured to also send the map M and/or the data relating to it.

In certain embodiments, the processing unit 101 is defined by a server arranged in any part of the world or, in particular, in a ski resort.

In another embodiment of this disclosure, the management system 100 comprises multiple snow groomer vehicles 1 of the type described above. In this embodiment, the processing unit 101 is configured to send the at least one area 50 of the map M and/or the data relating to it, the at least one of the parameters associated with the at least one area 50 of the map M, and the at least one value or range of values associated with the at least one of the parameters, and, preferably, the map M and/or the data relating to it, to some or all of the snow groomer vehicles 1 of the multiple snow groomer vehicles 1 via the communication unit 102 and the corresponding radio communication unit 18. In one embodiment, multiple areas 50 of the map M are defined and some areas 50 of the multiple areas 50 of the map M are sent to some snow groomer vehicles 1 of the multiple snow groomer vehicles 1, and other areas 50 of the multiple areas of the map M are sent to other snow groomer vehicles 1 of the multiple snow groomer vehicles 1. In this embodiment, each snow groomer vehicle 1 sends its own position to the processing unit 101.

In certain, but non-limiting, embodiments of this disclosure, one of more areas 50 of the map M have a position that varies over time. In particular, the one or more areas 50 of the map M are defined based on the position of one or more snow groomer vehicles 1. In particular, one or more areas 50 of the map M each vary respectively as the position of an associated snow groomer vehicle 1 varies; preferably, they are defined as a circumference with a centre corresponding to the respective position of the snow groomer vehicle 1 to which they are associated and having a given radius. In this embodiment, each area 50 associated with the position of a respective snow groomer vehicle 1 is not sent nor applied to said respective snow groomer vehicle 1 but is sent to some or all the snow groomer vehicles 1 of the snow groomer vehicle 1 fleet. In this way, when two snow groomer vehicles approach each other, both the snow groomer vehicles enter the area of the other and the at least one parameter of the snow groomer vehicle 1 is controlled by the respective control device 17 of each snow groomer vehicle 1 that has entered the area of the other with the same modes as the area 50 of the map M with a fixed position as indicated above.

In certain embodiments, with reference to FIG. 3, the management system 100 of a snow groomer vehicle comprises a user interface 110 coupled in communication with the processing unit 101, the user interface 110 is configured to receive from a user the at least one area 50 of the map M, and preferably the at least one of the parameters associated with the at least one area 50 of the map M, and preferably the at least one value or range of values associated with the at least one of the parameters to the snow groomer vehicle 1, and to send it to the processing unit 101.

In particular, the user interface 110 may be a computer, or a mobile device, for example a tablet, or a mobile phone or any other electronic device with a display unit in which the map M is displayed and an input unit through which the user may define, preferably by drawing, at least one area 50 of the map M, and preferably select the at least one of the parameters associated with the at least one area 50 of the map M, and preferably select the at least one value or range of values associated with the at least one of the parameters. These data am then sent by the user interface 110 to the processing unit 101 that, in its turn, sends them to the snow groomer vehicle 1.

Figure 4:
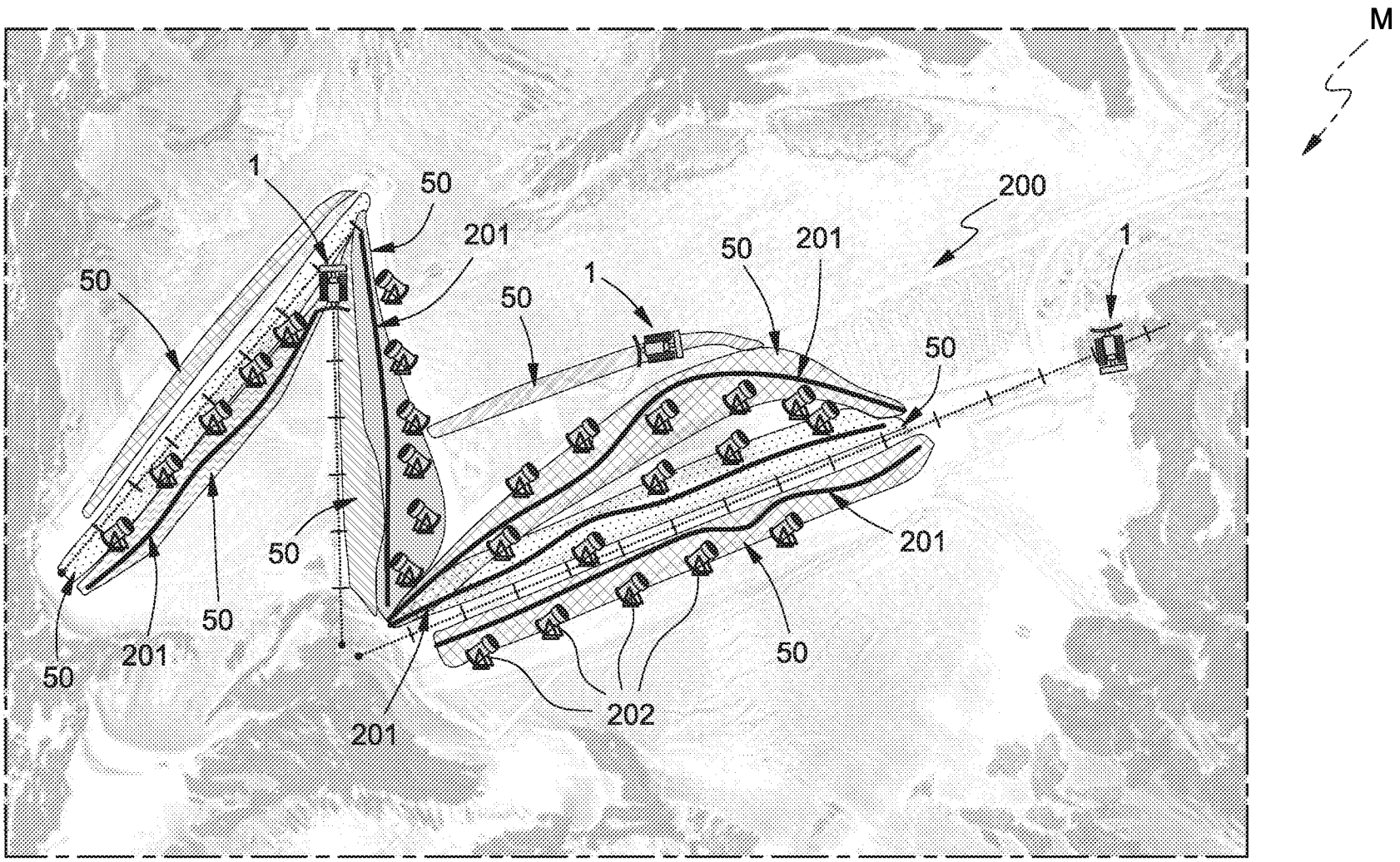
FIG. 4 is a map of a ski resort that illustrates snow groomer vehicles and areas of the map M.

With reference to FIG. 4, a ski resort 200 comprising the management system 100 comprising multiple snow groomer vehicles 1, as described above, and at least one ski slope 201 is illustrated, in which the map M represents the at least one ski slope.

In certain embodiments, the ski resort 200 comprises at least one snow production device 202 displaced along the at least one ski slope, and wherein a defined area 50 of the map M at least encompasses the position of the at least one snow production device 202.

In certain embodiments, the ski resort 200 is configured to control the operation of the snow production device 202 based on the proximity, or lack thereof of areas 50 defined by the position of a snow groomer vehicle 1, for example an area defined as a circumference with its centre in the snow groomer vehicle and with a given radius, which moves together with the snow groomer vehicle 1. In other words, if a snow groomer vehicle 1 approaches a snow production device 202 and, as a result, if the snow production device 202 is temporarily located in the area 50 defined by a snow groomer vehicle 1, the ski resort 200 adjusts the operation of the snow production devices 202; in other words, the ski resort is configured to set the operation parameters of the snow production device 202 based on the presence, or lack thereof, of the snow production device 202 within an area 50 of the map M defined based on the position of a snow groomer vehicle 1, for example by switching off the snow production device 202, or adjusting its range and/or pressure and/or other operation parameters.

In certain embodiments, an area of the map M may be defined by the area inside of which a garage or depot or shelter or station or ski lift pylon is located; in this case, the user may program specific parameters in these areas 50 to improve the relatively safety of the operator and to avoid relative damage or injury to physical elements, to the snow groomer vehicle, and to its operator. For example, it may switch on the lights of the snow groomer vehicle 1 or limit the maximum speed or set given parameters for the suspension of the snow groomer vehicle 1.

It is clear that variants to the present disclosure can be made without thereby departing from the scope of protection of the appended claims. That is, the present disclosure also covers embodiments that are not described in the detailed description above as well as equivalent embodiments that are part of the scope of protection set forth in the claims. Accordingly, various changes and modifications to the presently disclosed embodiments will be apparent to those skilled in the art.

The invention claimed is:

1. A snow groomer vehicle comprising:

a frame;

two tracks;

a drive unit connected to the two tracks and configured to move the snow groomer vehicle;

a working device connected to the frame by a connecting device, the working device selected from a winch, a tiller assembly and a shovel;

a control device configured to control at least one parameter of the snow groomer vehicle selected from: a speed of the snow groomer vehicle, a number of revolutions of the drive unit, a switching on of a light assembly of the snow groomer vehicle, a setting of the tiller assembly, a setting of the winch, a setting of the shovel, a position of the shovel with respect to three Cartesian axes, a setting of the snow groomer vehicle, a setting of a suspension of the snow groomer vehicle, a message to be sent on a display screen of the snow groomer vehicle, a setting of a speed limit, a setting of an alarm, a warning concerning driving a direction associated with entering a critical area, a warning of a risk of collision with an object, a distance indicator to another snow groomer vehicle during operation of a fleet snow groomer vehicles, a direction of rotation of a shaft of the tiller assembly, a depth of cut of the tiller assembly, an angle of cut of the tiller assembly, a position of the tiller assembly along a vertical axis, a mode of adjusting the position of the tiller assembly along the vertical axis, a mode in which the tiller assembly exerts a designated pressure on a snowpack, a mode in which the tiller assembly is in a floating position, a volume of a working chamber of the tiller assembly, a position of the tiller assembly with respect to a horizontal plane, and a mode of adjusting the position of the tiller assembly with respect to the horizontal plane;

a radio communication unit coupled to the control device and configured to receive external data and provide the external data to the control device;

a user interface comprising at least one drive control configured to receive control instructions from an operator relating to the at least one parameter of the snow groomer vehicle, the user interface being coupled to the control device and configured to send the control instructions to the control device; and a position detector configured to detect a position of the snow groomer vehicle, the position detector being coupled to the control device and configured to send the detected position to the control device, wherein the control device is configured to control, in a first operating mode, the at least one parameter based on the control instructions received via the user interface, the external data received via the radio communication unit, and the position detected via the position detector.

2. The snow groomer vehicle of claim 1, wherein the control device comprises a memory configured to store: data relating to a map, data relating to at least one area of the map, and data associated with the at least one parameter of the snow groomer vehicle relative to the at least one area of the map, the control device configured to determine whether the snow groomer vehicle is within the at least one area of the map based on the position detected by the position detector and control the at least one parameter in the first operating mode responsive to the snow groomer vehicle being within the at least one area of the map.

3. The snow groomer vehicle of claim 2, wherein the control device is configured to limit at least one of the speed of the snow groomer vehicle and the number of revolutions of the drive unit based on the position of the snow groomer vehicle received via the position detector responsive to the snow groomer vehicle being within the at least one area of the map.

4. The snow groomer vehicle of claim 2, wherein the control device is configured to switch on the light assembly of the snow groomer vehicle based on the position of the snow groomer vehicle received via the position detector responsive to the snow groomer vehicle being within the at least one area of the map.

5. The snow groomer vehicle of claim 2, wherein the control device is configured to send the message to the display screen of the snow groomer vehicle based on the position of the snow groomer vehicle received via the position detector responsive to the snow groomer vehicle being within the at least one area of the map.

6. The snow groomer vehicle of claim 1, wherein the user interface comprising at least one operating command which can be operated by the operator and the control device is configured to disregard the external data received via the radio communication unit and the position detected via the position detector and control the at least one parameter in a second operating mode when the at least one operating command is operated by the operator.

7. A management system comprising:

a snow groomer vehicle comprising:

a frame;

two tracks;

a drive unit connected to the two tracks and configured to move the snow groomer vehicle;

a working device connected to the frame by a connecting device, the working device selected from a winch, a tiller assembly and a shovel;

a control device configured to control at least one parameter of the snow groomer vehicle selected from: a speed of the snow groomer vehicle, a number of revolutions of the drive unit, a switching on of a light assembly of the snow groomer vehicle, a setting of the tiller assembly, a setting of the winch, a setting of the shovel, a position of the shovel with respect to three Cartesian axes, a setting of the snow groomer vehicle, a setting of a suspension of the snow groomer vehicle, a message to be sent on a display screen of the snow groomer vehicle, a setting of a speed limit, a setting of an alarm, a warning concerning driving a direction associated with entering a critical area, a warning of a risk of collision with an object, a distance indicator to another snow groomer vehicle during operation of a fleet snow groomer vehicles, a direction of rotation of a shaft of the tiller assembly, a depth of cut of the tiller assembly, an angle of cut of the tiller assembly, a position of the tiller assembly along a vertical axis, a mode of adjusting the position of the tiller assembly along the vertical axis, a mode in which the tiller assembly exerts a designated pressure on a snowpack, a mode in which the tiller assembly is in a floating position, a volume of a working chamber of the tiller assembly, a position of the tiller assembly with respect to a horizontal plane, and a mode of adjusting the position of the tiller assembly with respect to the horizontal plane;

a radio communication unit coupled to the control device and configured to receive external data and provide the external data to the control device;

a user interface comprising at least one drive control configured to receive control instructions from an operator relating to the at least one parameter of the snow groomer vehicle, the user interface being coupled to the control device and configured to send the control instructions to the control device; and a position detector configured to detect a position of the snow groomer vehicle, the position detector being coupled to the control device and configured to send the detected position to the control device, wherein the control device is configured to control, in a first operating mode, the at least one parameter based on the control instructions received via the user interface, the external data received via the radio communication unit, and the position detected via the position detector;

a communication unit housed in a device remote from the snow groomer vehicle, wherein the communication unit is configured to be in communication with the radio communication unit of the snow groomer vehicle; and a processing unit comprising a memory configured to store: data relating to a map, data relating to at least one area of the map, and data associated with the at least one parameter of the snow groomer vehicle relative to the at least one area of the map, the processing unit configured to send, via the communication unit, the data relating to the map, the data relating to the at least one area of the map, and the data associated with the at least one parameter of the snow groomer vehicle relative to the at least one area of the map to the snow groomer vehicle.

8. The management system of claim 7, further comprising a plurality of snow groomer vehicles, wherein the processing unit is configured to receive, from each of the plurality of snow groomer vehicles, data associated with the position of that snow groomer vehicle and to send, to the plurality of snow groomer vehicles, the data relating to the map, the data relating to the at least one area of the map, and data associated with at least one parameter of that snow groomer vehicle relative to the at least one area of the map.

9. The management system of claim 8, wherein the memory of the processing unit stores data associated with a plurality of areas of the map and the processing unit is configured to send data associated with a first group of areas of the plurality of areas of the map to a first group of snow groomer vehicles of the plurality of snow groomer vehicles, and send data associated with a second group of areas of the plurality of areas of the map to a second group of snow groomer vehicles of the plurality of snow groomer vehicles.

10. The management system of claim 9, wherein at least one area of the plurality of areas of the map is defined based on the position of at least one of the plurality of snow groomer vehicles such that each area of the map varies as the position of the snow groomer vehicle with which it is associated varies.

11. The management system of claim 7, further comprising another user interface in communication with the processing unit, the other user interface configured to:

display the map, receive, from a user, an indication of the at least one area of the map, and send data associated with the indication to the processing unit.

12. The management system of claim 7, wherein the map shows at least one ski slope.

13. The management system of claim 12, wherein the map shows a position of a snow production device displaced along the at least one ski slope.

14. A method comprising:

checking at least one parameter of a snow groomer vehicle comprising a frame, two tracks, a drive unit connected to the two tracks to move the snow groomer vehicle, a working device connected to the frame by a connecting device and being selected from a winch, a tiller assembly and a shovel, the at least one parameter selected from: a speed of the snow groomer vehicle, a number of revolutions of the drive unit, a switching on of a light assembly of the snow groomer vehicle, a setting of the tiller assembly, a setting of the winch, a setting of the shovel, a position of the shovel with respect to three Cartesian axes, a setting of the snow groomer vehicle, a setting of a suspension of the snow groomer vehicle, a message to be sent on a display screen of the snow groomer vehicle, a setting of a speed limit, a setting of an alarm, a warning concerning driving a direction associated with entering a critical area, a warning of a risk of collision with an object, a distance indicator to another snow groomer vehicle during operation of a fleet snow groomer vehicles, a direction of rotation of a shaft of the tiller assembly, a depth of cut of the tiller assembly, an angle of cut of the tiller assembly, a position of the tiller assembly along a vertical axis, a mode of adjusting the position of the tiller assembly along the vertical axis, a mode in which the tiller assembly exerts a designated pressure on a snowpack, a mode in which the tiller assembly is in a floating position, a volume of a working chamber of the tiller assembly, a position of the tiller assembly with respect to a horizontal plane, and a mode of adjusting the position of the tiller assembly with respect to the horizontal plane;

receiving external data via a radio communication unit;

receiving control instructions from an operator related to the at least one parameter of the snow groomer vehicle;

detecting the position of the snow groomer vehicle; and controlling, in a first operating mode, the at least one parameter based on the control instructions, the external data and the detected position.

15. The method of claim 14, further comprising:

storing at least one of data related to a map and data related to at least one area of the map;

associating with the at least one area of the map the at least one parameter of the snow groomer vehicle;

determining, based on the detected position, whether the snow groomer vehicle is within the at least one area of the map; and checking the at least one parameter according to the first operating mode responsive to the snow groomer being within the at least one area of the map.

16. The method of claim 15, further comprising adjusting at least one of the speed of the snow groomer vehicle and the number of engine revolutions of the drive unit responsive to the position of the snow groomer vehicle being within the at least one area of the map.

17. The method of claim 15, further comprising switching on the light assembly of the snow groomer vehicle responsive to the detected position of the snow groomer vehicle being within the at least one area of the map.

18. The method of claim 15, further comprising sending a message to the display screen responsive to the detected position of the snow groomer vehicle being within the at least one area of the map.

19. The method of claim 15, wherein the data related to the map and the data related to the at least one area of the map are stored remote from the snow groomer vehicle and further comprising sending at least one of the data related to the map and the data related to the at least one area of the map to the groomer vehicle.

20. The method of claim 15, further comprising sending the data related to the at least one area of the map to a plurality of snow groomer vehicles, and sending the position of each snow groomer vehicle of the plurality of snow groomer vehicles to a remotely housed processing unit.

21. The method of claim 20, further comprising storing data associated with a plurality of areas of the map, sending data relating to certain areas of the map to a first group of the plurality of snow groomer vehicles and sending data relating to certain other areas of the map to a second group of the plurality of snow groomer vehicles.

22. The method of claim 15, further comprising displaying the map to a user and receiving, from the user, a selection of the at least one area of the map.

23. The method of claim 15, wherein the map shows at least one ski slope.

24. The method of claim 23, wherein the map shows a position of a snow production device displaced along the at least one ski slope.

25. The method of claim 14, further comprising, responsive to receiving an operational control instruction by an operator, disregarding the data received via the radio communication unit and the detected position, and controlling the at least one parameter in a second operating mode.

* * * * *